United States Patent [19]

Bratchell

[11] 4,051,216

[45] Sept. 27, 1977

[54] IN-LINE MOULDING OF PRESTRESSED CONCRETE ARTICLES

[75] Inventor: Robert Lyndon Bratchell, Ottoway, Australia

[73] Assignee: Concrete Industries (Monier) Limited, Ottoway, Australia

[21] Appl. No.: 529,365

[22] Filed: Dec. 4, 1974

Related U.S. Application Data

[63] Continuation-in-part of Ser. No. 295,996, Oct. 10, 1972, abandoned.

[30] Foreign Application Priority Data

Oct. 27, 1971 Australia ..... 6809/71

[51] Int. Cl.[2] ..... B28B 23/04

[52] U.S. Cl. ..... 264/157; 29/452; 264/228; 264/251; 264/297; 425/111

[58] Field of Search ..... 264/228, 297, 261, 157, 264/251; 425/111; 52/223 R; 254/29 A; 29/452

[56] References Cited

U.S. PATENT DOCUMENTS

| | | | |
|---|---|---|---|
| 3,070,867 | 1/1963 | Belle | 264/228 X |
| 3,157,721 | 11/1964 | Barish | 264/261 X |
| 3,186,679 | 1/1965 | Williams | 264/228 X |
| 3,608,163 | 9/1971 | Harford | 425/111 X |

*Primary Examiner*—Thomas P. Pavelko
*Attorney, Agent, or Firm*—Oldham & Oldham Co.

[57] ABSTRACT

A method of moulding concrete ties or other similar articles having pre-stressed reinforcing wires or rods therein, wherein a series of open ended multi-cavity moulds of similar cross-sectional shape are aligned end to end in groups, wires are positioned in the aligned cavities of the moulds and are tensioned, the wires are separated from one another and into horizontal rows in each group by flat sided bar like spacers which are interposed between the ends of adjacent moulds of that group, while the groups themselves are separated by vertically movable spacer plates each having vertically extended slots which arrange the wires into vertical rows. The wet mix of concrete is then discharged into the moulds to surround the reinforcing wires, and after initial set of the concrete the flat sided bar like spacers are withdrawn laterally while the vertically slotted spacer plates are depressed downwardly, and the wires thus exposed between the adjacent moulds and also between the adjacent groups are severed by a driven cutter disc of abrasive material.

6 Claims, 8 Drawing Figures

IN-LINE MOULDING OF PRESTRESSED CONCRETE ARTICLES

This invention is a Continuation-in-Part of U.S. application Ser. No. 295,996, now abandoned and relates to a method of production of pre-stressed concrete articles, and is particularly suited to mass-production of pre-stressed concrete railway ties.

CROSS-REFERENCES

The prior art which is known to the Applicant includes the U.S. Pat. Nos. 3,186,679 issued to Williams and 3,070,867 issued to Belle. Each teaches the use of a strand holder and dam means to partition mould cavities into a series of moulds aligned end to end and containing pre-stressed reinforcements extending through the series of moulds. Concrete is poured into the moulds, and after the concrete has set the dam is withdrawn to expose the reinforcing wires which are subsequently cut. The U.S. Pat. No. 2,394,227 Barber discloses a common reinforcing element extending through the series of aligned moulds.

The U.S. Pat. No. 2,397,728 issued to Dowsett which further teaches the use of combination dam strand holders, casting of concrete, removal of the dam strand holders and cutting the reinforcing wires. The U.S. Pat. No. 3,608,163 issued to Harford also teaches production of pre-stressed concrete members wherein a plurality of open ended moulds are aligned end to end and are also aligned side by side.

BACKGROUND OF THE INVENTION

In order for concrete railway ties to satisfactorily compete with timber ties it is necessary for costs to be reduced as far as possible. Thus the time taken in the removal of the spacer members from between aligned open ended moulds is critical when the number of ties cast in a single run of the hopper is considerable. It is of course essential that a large number of ties be cast in a single work shift, and the main object of this invention is to provide improvements which result in considerable time savings over any of the methods which have been disclosed in the specifications referred to above, or in commercially known techniques which have been used heretofore.

The severing of the wires between the moulds after removal of the spacers is a process which is frequently time consuming. According to the most usual method of production, the space between the ends of aligned moulds is quite considerable, and severing is effected by means of either a cutting wheel or an oxy torch. Usually the wires are severed adjacent the ends of the ties in one multi-cavity mould, and subsequently severed adjacent the ends of the ties in an adjacent multi-cavity mould, the short lengths of wires being discarded. This results in at least two passes of a cutting tool, and it is therefore a time consuming operation. A still further object of this invention is to provide improvements whereby the wires can be severed with a single pass of a cutter.

BRIEF SUMMARY OF THE INVENTION

Briefly the invention constitutes a method of moulding concrete ties which comprises the steps of firstly aligning a series of multi-cavity open ended moulds end to end in a series of groups. Each multi-cavity mould has a row of cavities extending transversely across it. The cavities of the aligned moulds are themselves aligned, and reinforcing wires are arranged in parallel array within each of the aligned cavities of the moulds. The wires are strained at the ends of the moulds, and a series of flat sided bar like spacers are positioned horizontally between the ends of the moulds and between the rows of wires so as to divide the wires into horizontal rows. Between each group of a plurality of (for example eight) multi-cavity moulds there is provided a flat spacer plate having vertically extending slots, and these slots align the wires into vertical rows, so that the wires are aligned in two planes by the bar like spacers and the flat spacer plates. The wet mix of concrete is then discharged into the moulds, vibrated, screeded and allowed to set, but after initial set of the concrete the flat sided bar like spacers are withdrawn from between the horizontal rows of wires in a lateral direction and the spacer plates are depressed in a vertically downward direction to thereby expose the wires between the adjacent ends of the moulds and between the groups. The wires are subsequently severed with a rotationally driven cutter disc of abrasive material.

Besides being capable of fulfilling the above defined objects of the invention, the method disclosed herein also ensures that the relatively "green" concrete is not fractured in the removal of the bar like spacers or the flat spacer plates. The adhesion between the bar like spacers and the concrete is broken by a reaction against the side walls of the moulds, which may be regarded as relatively rigid, while the adhesion between the vertically movable flat spacer plates on the concrete is broken against the resistance offered against the bases of the moulds. Still further, the method can be effected by use of a simple and inexpensive machine which is nevertheless very quick in its operation for removal of the spacers. Further, the severing of the wires between the moulds can be effected with a rotationally driven cutter disc of thickness which is only slightly less than the thickness of the bar like spacers or the vertically movable flat spacer plates so that the amount of wire projecting from the tie ends can be so small as to be disregarded, this avoiding the need for a second pass between each pair of adjacent moulds.

BRIEF DESCRIPTION OF THE SEVERAL VIEWS OF THE DRAWINGS

In the accompanying drawings.

Figure 1:
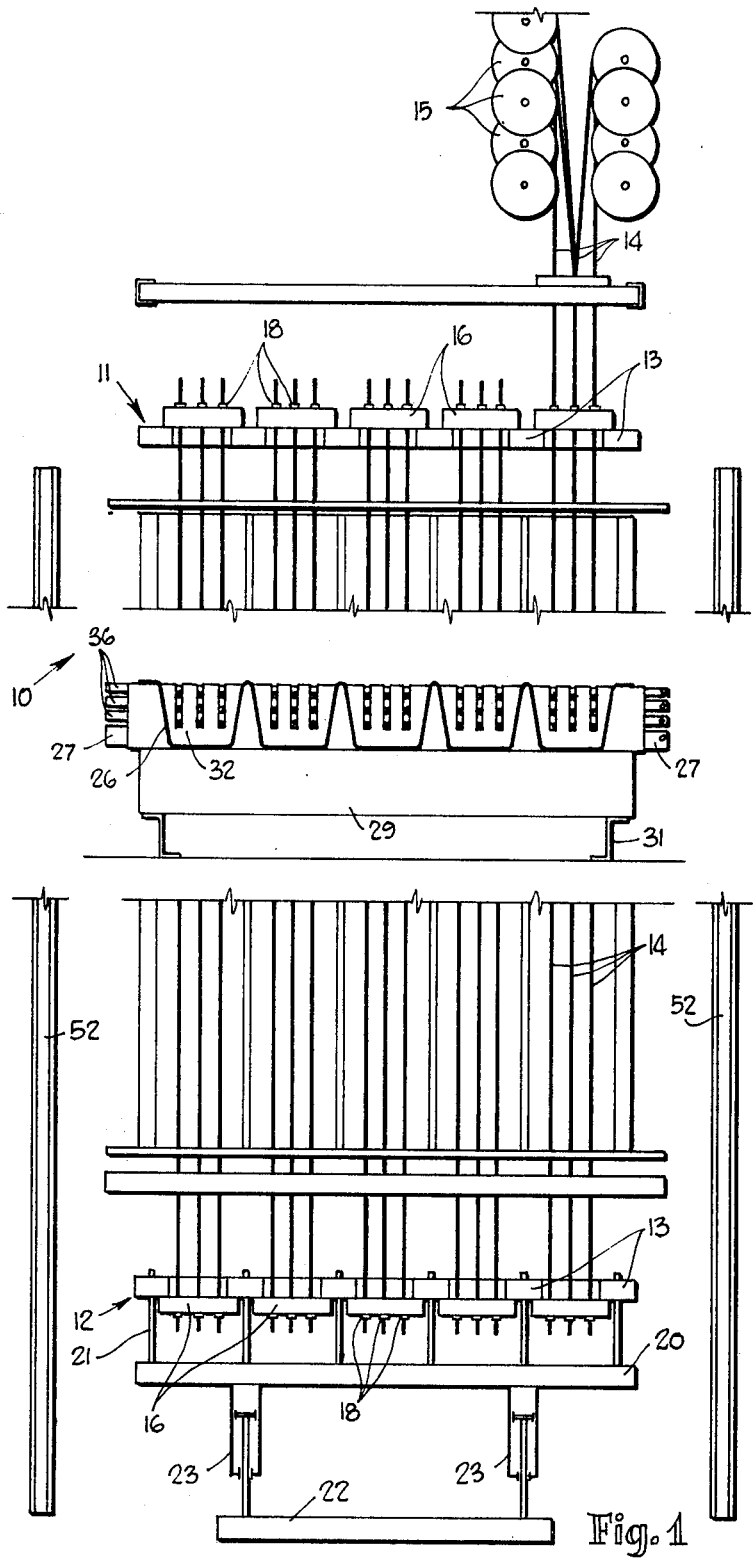
FIG. 1 is a diagrammatic plan view showing intermediate its ends a section view, and illustrating a bay which contains a series of similar multi-cavity open ended moulds aligned end to end.

A bay for the moulding of concrete ties is generally designated 10 in FIG. 1 and is provided with a fixed beam 11 at one end and a movable beam 12 at the other. Each of the beams 11 and 12 is provided with a pair of upstanding abutment bars designated 13, and these abutment bars 13 apply a tensioning strain to the reinforcing wires 14 which are taken from the reels 15 and passed through the anchor blocks 16 at respective ends of the bay 10. For the sake of simplicity nine wires only are shown as lying in each group of aligned cavities of the moulds, but in practice the number of wires is more likely to be sixteen. The wires are fixed temporarily to the anchor blocks 16 by means of colletts 18 in accordance with standard practice in the art.

As said above the beam 10 is movable, being coupled to a load transfer cross-member 20 by means of tension plates 21, while the load transfer cross-member 20 is itself coupled to an anchor bolster 22 by means of hydraulic cylinders 23. Actuation of the hydraulic cylinders 23 applies a tensioning strain to the wires 14.

The multi-cavity moulds are designated 26, each mould 26 having fire cavities extending through it and being open at its two ends. The cavities extend in a longitudinal direction and are spaced transversely from one another. The moulds are aligned in the bay 10 in an end to end array, with corresponding cavities themselves being aligned so that the corresponding aligned cavities contain the reinforcing wires 14 which extend through a considerable number of aligned moulds 26, and in the embodiment being described some hundreds of concrete ties are moulded in a single pouring operation of concrete. However before the first wire are laid in the cavities from the reels 15 the lowermost of a group of four flat sided bar like spacers designated 27 is positioned on short longitudinal bridge members 28 (FIG. 3) which extend between cross members 29 themselves supported on longitudinal members 31 as shown best in FIG. 6, and the wires are supported during their laying out by these spacers 27. This occurs in seven out of every group of eight multi-cavity moulds 26, and between the groups of eight there are interposed respective flat spacer plates designated 32 and best seen in FIG. 3. The spacer plates 32 each are provided with transversely spaced vertically extending slots 33 which extend downwardly from respective upper edges 34, but at this stage in the method of moulding the ties the spacer plates 32 are in their lowered positions. (The lowering of the spacer plates 32 is illustrated separately in FIG. 5).

Figure 3:
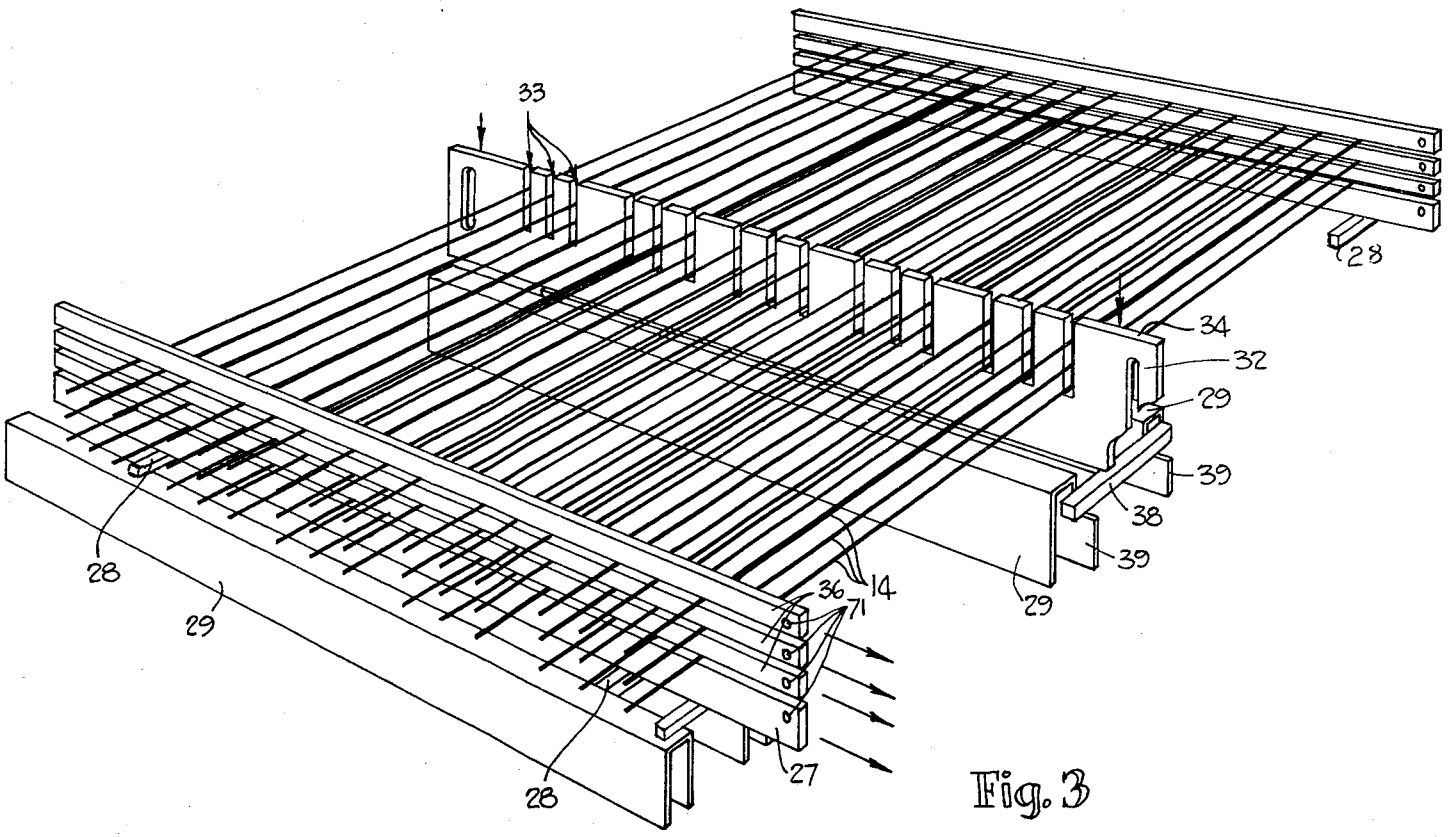
FIG. 3 is a perspective view showing the arrangement for retaining the reinforcing wires in horizontal rows and also in vertical rows, the moulds being emitted from FIG. 3 for the purpose of clarity.

The wires are tensioned as said above, and after tensioning the remaining three flat sided bar like spacers designated 36 are positioned between the wires 14 and above the wires 14 as best seen in FIG. 3, and these serve to reduce the amount of sag due to catenary and also to arrange the wires in horizontal rows.

After the wires have thus been arranged in horizontal rows, the spacer plates 32 are lifted to the positions shown, for example in FIGS. 1 and 3, and the slots 33 also arrange the wires in respective vertical rows, in the embodiment shown there being three wires in each horizontal row and three wires in each vertical row and each mould cavity. The spacer plates 32 are retained in their upper positions by short bars designated 38 which rest on projections 39 on the relevant cross-members 29. Again this is best seen in FIG. 3.

There is essentially a small clearance to allow insertion of the spacers 27 and 36, and lifting of the spacer plates 32, but it is desirable that the spacer bars and spacer plates should function as closure members for the open ended moulds. Accordingly the moulds are simply driven along the supporting cross-members 29 towards one another to close any gaps which may exist. The spacers then form the dual functions of retaining the reinforcing wires in their respective rows and closing the ends of the moulds.

Figure 2:
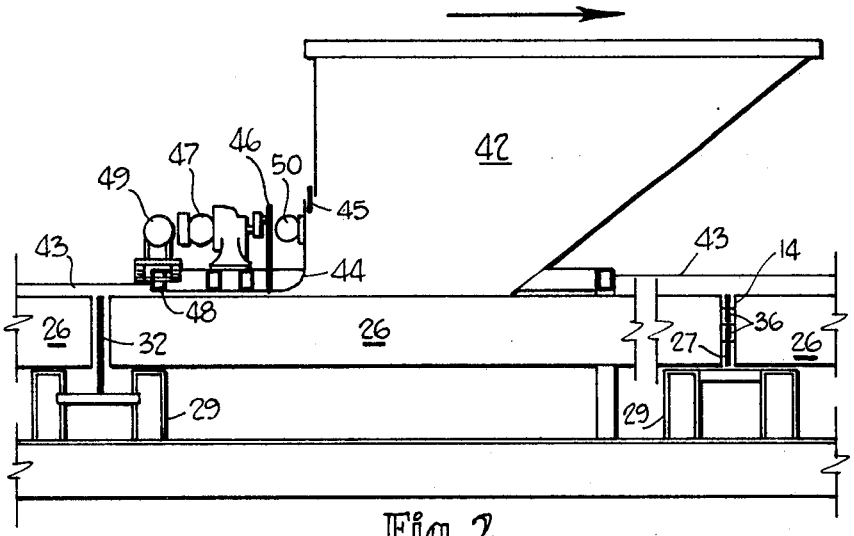
FIG. 2 is a fragmentary side elevation showing the discharge of wet mix of concrete into the moulds.
Figure 7:
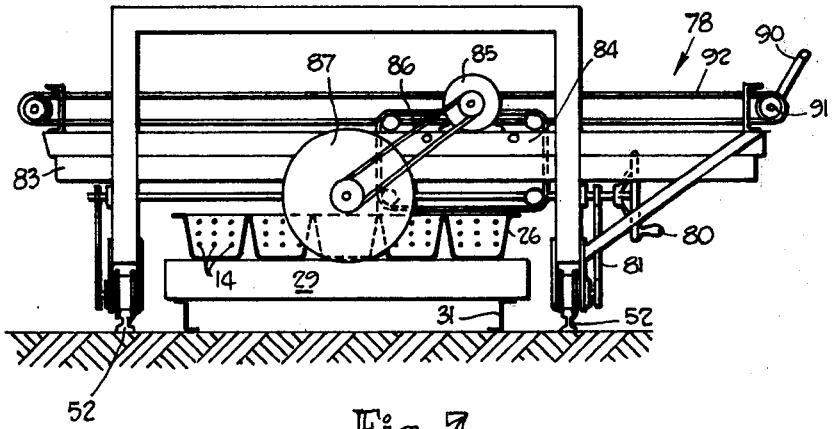
FIG. 7 is a cross-sectional view through the bay and illustrating in some detail the machine for severing the wires between each pair of adjacent moulds.

The wet mix of concrete is then discharged from a hopper which is designated 42 in FIG. 2 the hopper being drawn along the bay by a winch rope designated 43 coupled to a winch (not shown). The hopper 42 is provided with a screed plate 44, the screed plate 44 being coupled to the side wall of the hopper 42 through a rubber sheet 45 the hopper 42 also carrying on it a motor driven screed bar designated 46 and driven by a motor 47 with a back and forth motion. A vibrator screed bar 48 is agitated by the vibrator 49 to give the optimum moulding conditions for the ties, while the vibrator 50 is coupled to the hopper screed plate 44 again to consolidate the concrete as it is discharged from the hopper 42. The hopper is supported by wheels (not shown) carried on the rails 52 which extend along the bay.

Figure 4:
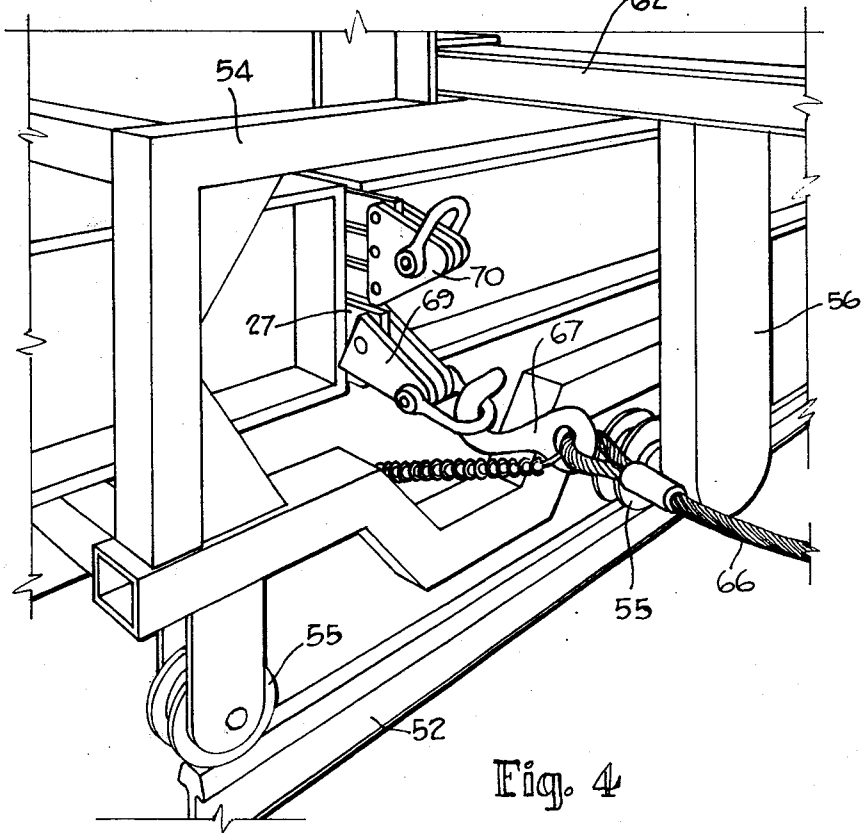
FIG. 4 is a fragmentary perspective view illustrating the lateral withdrawal of the flat sided bar like spacers which are interposed between adjacent moulds of each group.
Figure 5:
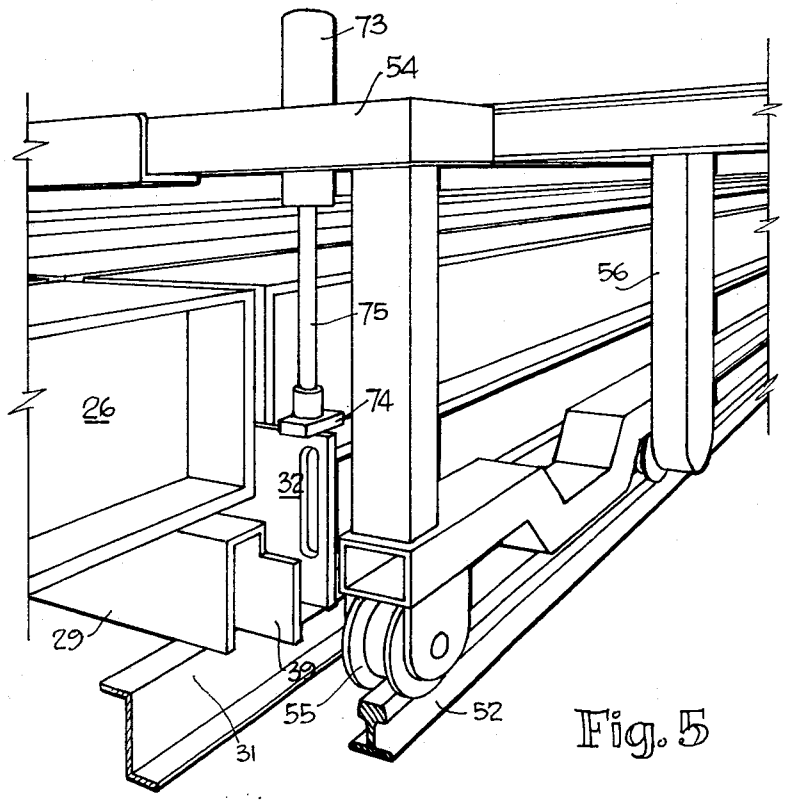
FIG. 5 is a fragmentary perspective view illustrating the depression of the flat spacer plates from between the rows of wires in a vertically downwards direction.
Figure 6:
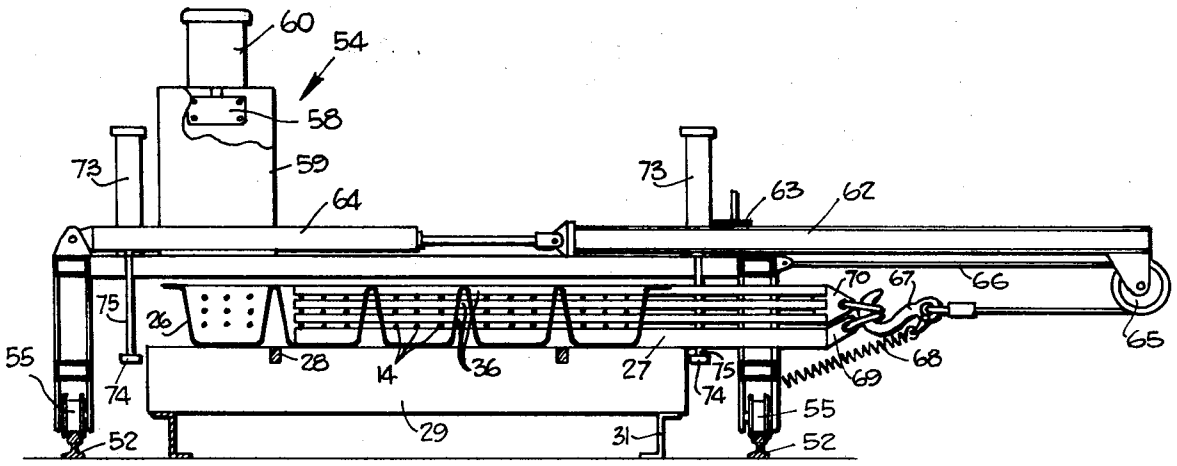
FIG. 6 is a section drawn to an enlarged scale showing in further detail the machine illustrated in FIGS. 4 and 5 for the removal of the spacers and spacer plates.

After the concrete has been poured into the moulds, steam is applied to accelerate setting of the concrete, and during the setting the tension is maintained on the wires 14. However after setting has taken place, a machine which is illustrated in FIGS. 4, 5, and 6 and designated 54 is moved along the rails 52, the machine being supported by wheels 55 which engage the rails 52. The machine is driven by a drive motor which is not illustrated herein, the illustration showing only the drive chain cover 56. However the drive motor is a hydraulic motor and is itself driven by means of a hydraulic pump 58 (FIG. 6) carried on a reservoir 59 and energised by an electric motor 60. The machine 54 is provided with a transversely movable boom 62 guided by a guide 63, and coupled to a transverse hydraulic cylinder 64 (all illustrated in FIG. 6). The cylinder is actuated by pressure fluid delivered by the pump 58. The outstanding end of the boom 62 carries on it pulley 65 coupled by a cable 66 to a hook 67, the other end of the cable 66 being coupled to the machine. The hook 67 is provided with a return spring 68 for assisting retreaval after withdrawal of the flat sided bar like spacers 27 and 36. After initial setting of the concrete, but before curing, the spacers are coupled to the hook 67 by means of coupling plates designated 69 and 70 as illustrated in FIGS. 4 and 6, and the coupling plates 69 and 70 engage in apertures designated 71 in the ends of the bars 27 and 36 as illustrated in FIG. 3. The plates 69 and 70 are provided with pins to enable quick insertion into the apertures 71.

The pump 58 is also arranged to energize through valve means (not shown) a depressing cylinder 73, which is shown in FIGS. 5 and 6. The depressing cylinder 73 has a pad 74 on the lower end of its piston rod 75, there being provided two cylinders 73 one on each side of the moulds 26 as shown in FIG. 6. These are operative to depress the spacer plates 32 downwardly away from the wires so as to expose the wires for severing. This depression of the plates 32 in a vertically downwards direction is best seen in FIG. 5.

Figure 8:
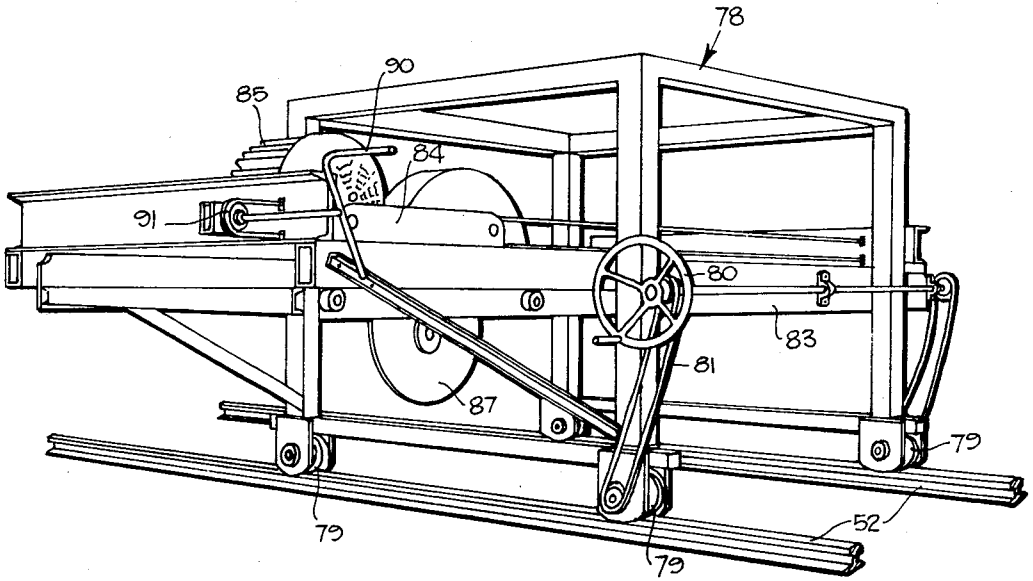
FIG. 8 is a perspective view of the machine which is illustrated otherwise in FIG. 7.

After the spacer bars and spacer plates have been removed, the tension on the wires 14 is relaxed by reverse actuation of the hydraulic cylinders 23 at the end of the bay 10, and a machine which is designated herein 78 is supported by rail engaging wheels 79 on the rails 52 and moved along the bay. This movement is effected by a hand wheel 80 coupled by a chain 81 to two of the wheels 79 as shown best in FIG. 8. The machine 78 is provided with a transverse frame 83 having guide means thereon which guide a transversely movable carriage 84, the carriage 84 itself carrying an electric motor 85 coupled by a belt 86 to drive an abrasive cutting wheel 87, the thickness of the cutting wheel 87 being less than the thickness of any of the spacers 27, 36 or 32 by such a small amount that not more than five millimeters of severed reinforcing wire will project outwardly from any of the ties in any of the adjacent moulds after severing of the cutter wheel 87. This avoids an otherwise expensive double pass of the cutter wheel 87 between adjacent moulds. The transverse movement of the carriage 84 is effected by means of a handle 90 having a sprocket 91 thereon which drives a chain 92 coupled to the carriage 86.

Power supply for the electric motors 60 and 85, for the vibrators 49 and 50 and for the motor 47 is supplied by a conductor bank extending along the bay 10 the conductor bank however being of standard type known in the art, and for this reason it is not described nor illustrated herein.

After the concrete has been moulded, it is discharged from the moulds by a method which is separately described and claimed in a continuation in part application based on our U.S. application Ser. No. 295,938 dated Oct. 10, 1972.

It has been found that there is a very considerable saving of man power by use of this invention, and it is believed that this invention and its companion inventions the subject of U.S. Pat. Nos. 3,827,132 and 3,868,200 and U.S. Pat. application Ser. No. 295,938 result in a very much higher production rate than has heretofore been achieved in the art of moulding concrete ties, or other concrete beams containing reinforcing wires under strain.

I claim:

1. A method of moulding concrete ties comprising the steps:

aligning a series of similar multi-cavity open ended moulds end to end in a plurality of groups, and between end beams at the ends of a bay, positioning a series of reinforcing wires in parallel spaced relationship with one another in the aligned cavities of the moulds and between the end beams, securing the ends of the reinforcing wires to said end beams and straining said reinforcing wires, positioning a series of flat sided bar-like spacers between the ends of adjacent moulds of each group and between the reinforcing wires so that:

a. the spacers function as closure members for the ends of the moulds, the opposite flat sides thereof becoming contiguous mould ends, and b. the upper and lower edges of the spacers engage the reinforcing wires to retain them in horizontal rows, each said flat-sided bar-like spacer extending across the width of the multi-cavity moulds and spaced vertically from adjacent said flat-sided bar-like spacers solely by the wires retained by said adjacent bars in a said horizontal row, positioning a plurality of flat spacer plates each between adjacent ends of said groups, each plate extending across the width of the multi-cavity moulds and having transversely spaced vertically extending slots extending downwardly from its upper edge, and elevating the flat plates to engage the wires in the slots and also to cause its opposite side faces to function as closure means for contiguous mould ends, the edges defining the slots retaining the wires in vertical rows, driving the moulds towards one another by an amount sufficient to close any gaps which exist between the mould ends and said spacers and said spacer plates, discharging a wet mix of concrete into the moulds to surround the reinforcing wires and allowing the concrete to set, withdrawing the flat-sided bar-like spacers endwise from between the horizontal rows of wires in a lateral direction and depressing flat spacer plates from between the rows of wires in a vertically downwards direction against resistance to concrete fracture by the mould bases to thereby expose the wires between adjacent ends of aligned moulds, and between the groups, and severing the wires between each pair of adjacent moulds.

2. A method according to claim 1, wherein cross-members extend across and beneath the multi-cavity moulds, further comprising positioning bars on projections of cross-members and between adjacent ends of said groups and supporting said flat spacer plates on the bars during said discharging of the concrete wet mix, and removing the bars after the concrete has set and before said depressing of the flat spacer plates.

3. A method according to claim 1 further comprising moving a machine over the moulds after setting but before curing of the concrete, said machine having a transversely movable boom with a pulley on its outer end and a cable extending over the pulley, said method further comprising coupling the cable to said bar-like spacers and effecting actuation of the boom so as to in turn effect the said withdrawal of the flat sided bar like spacers.

4. A method according to claim 3 wherein said machine also comprises a pair of depressing cylinders, one each side of the moulds, and said depressing of the flat spacer plates is effected by actuating the depressing cylinders to drive the plates in a vertical downwards direction.

5. A method according to claim 1 further comprising relaxing the tension in the reinforcing wires after the concrete has cured, moving a severing machine over the moulds, said severing machine having a rotational driven abrasive wheel of thickness less than the thickness of the bar like spacers or flat spacer plates, and being carried on a transversely movable carriage and transversely moving the carriage to traverse the wheel between adjacent ends of the moulds to thereby effect said severing of the wires.

6. A method of moulding concrete ties as in claim 1, and including severing the wires with a single pass of a rotationally driven cutter disc of a size as to leave not more than five millimeters of wire.

* * * * *